US005125579A

United States Patent [19]

Eggert

[11] Patent Number: 5,125,579

[45] Date of Patent: Jun. 30, 1992

[54] JET SPRAY NOZZLE

[76] Inventor: Uwe Eggert, Cedergatan 12, S-335 00 Gnosjö, Sweden

[21] Appl. No.: 576,529

[22] PCT Filed: Feb. 7, 1989

[86] PCT No.: PCT/SE89/00046

§ 371 Date: Oct. 5, 1990

§ 102(e) Date: Oct. 5, 1990

[87] PCT Pub. No.: WO89/10161

PCT Pub. Date: Nov. 2, 1989

[30] Foreign Application Priority Data

Apr. 28, 1988 [SE] Sweden ..... 8801591

[51] Int. Cl.[5] ..... A62C 31/03; B05B 1/12

[52] U.S. Cl. ..... 239/439; 239/498; 239/505; 239/514; 239/579

[58] Field of Search ..... 239/437, 438, 439, 498, 239/505, 513, 514, 579

[56] References Cited

U.S. PATENT DOCUMENTS

| | | | |
|---|---|---|---|
| 1,416,401 | 5/1922 | Dudley | 239/514 X |
| 2,044,445 | 6/1936 | Price et al. | 239/514 X |
| 2,763,514 | 9/1956 | Hansen et al. | 239/498 X |
| 2,928,611 | 3/1960 | Lauderback et al. | 239/439 |
| 2,936,960 | 5/1960 | Thompson | 239/514 X |
| 3,045,926 | 7/1962 | Steinen | 239/505 X |
| 3,494,561 | 2/1970 | Buehler | 239/498 X |
| 3,514,042 | 5/1970 | Freed | 239/439 X |
| 4,328,868 | 5/1982 | Monte et al. | 239/498 X |
| 4,614,303 | 9/1986 | Moseley, Jr. et al. | 239/579 X |

FOREIGN PATENT DOCUMENTS

| | | | |
|---|---|---|---|
| 178366 | 7/1935 | Switzerland . | |
| 1005935 | 3/1983 | U.S.S.R. | 239/505 |
| 580554 | 9/1946 | United Kingdom . | |

*Primary Examiner*—Andres Kashnikow
*Assistant Examiner*—William Grant
*Attorney, Agent, or Firm*—Dvorak and Traub

[57] ABSTRACT

The object of the invention is to provide a thin, close curtain of liquid, for instance in fire-fighting. According to the invention, this is achieved by use of a nozzle having a central control body which is movable within an outer sleeve, both the control body and the outer sleeve having gently tapering wall portions facing each other. The gently tapering portion of the control body merges smoothly into the rear side of a disc-shaped end portion provided thereon, such that the liquid, in a thin layer, will follow the central control body and be deflected into a substantially radial direction relative to the nozzle so as to form a liquid curtain directed transversely in relation to the nozzle.

1 Claim, 3 Drawing Sheets

JET SPRAY NOZZLE

The present invention relates to a jet spray nozzle, preferably for fire-fighting, which is adjustable between a position for producing a concentrated jet and a position for producing a scattered jet, by axial displacement of a central control body in relation to an outer sleeve surrounding the central control body which, counting in the direction of flow, has a narrow neck portion merging into a disc-shaped end portion.

The primary object of the invention is to provide a jet spray nozzle of the above-mentioned type which makes it possible, in an efficient manner and with a minimum of flow losses, to produce a thin-layer, yet close curtain of liquid efficiently spread in the transverse direction of the nozzle. In fire-fighting, it may prove highly essential to be able to produce such a water curtain, for instance when the firemen should enter premises which are overheated and/or filled with smoke. The liquid curtain may then be used as a protective shield.

According to the invention, this object is achieved by a jet spray nozzle substantially characterised in that the central control body has a portion gently tapering, preferably conically, in the direction of flow and smoothly merging into the rear side of said disc-shaped end portion, said outer sleeve having a similarly gently tapering internal portion and terminating at some distance behind the rear side of the disc-shaped end portion when said control body is in a position of displacement in which a narrow annular passage is formed between said gently tapering portions of the control body and of the outer sleeve, such that liquid flowing through the nozzle will follow the gently tapering portion of the control body in a thin layer and at a high velocity and be gently deflected outwards into a radial direction while still flowing in a thin layer along the rear side of the disc-shaped end portion of the control body so as to form an extended curtain in front of the jet spray nozzle.

Suitably, the gently tapering portion of the outer sleeve narrows into an inner diameter which is smaller than or equal to the outer diameter of the control body at the point where the gently tapering portion thereof starts, such that the nozzle can be shut off by moving the control body forwards into engagement with the tapering portion of the outer sleeve.

Preferably, the outer sleeve further has a cylindrical mouth portion into which the disc-shaped end portion of the control body can be retracted for producing a concentrated jet.

Figure 1:
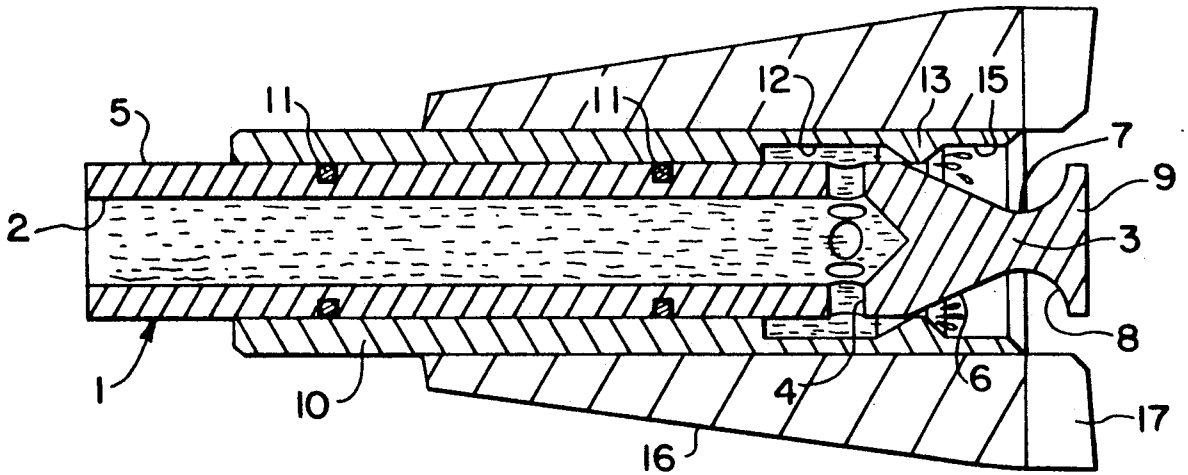
Figure 2:
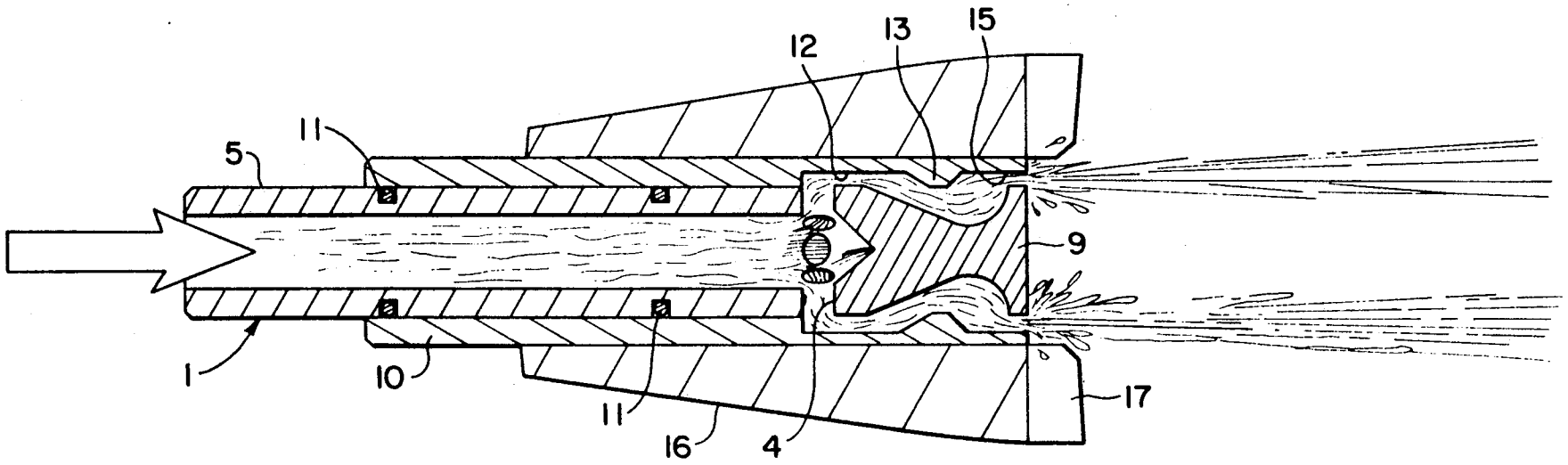
Figure 3:
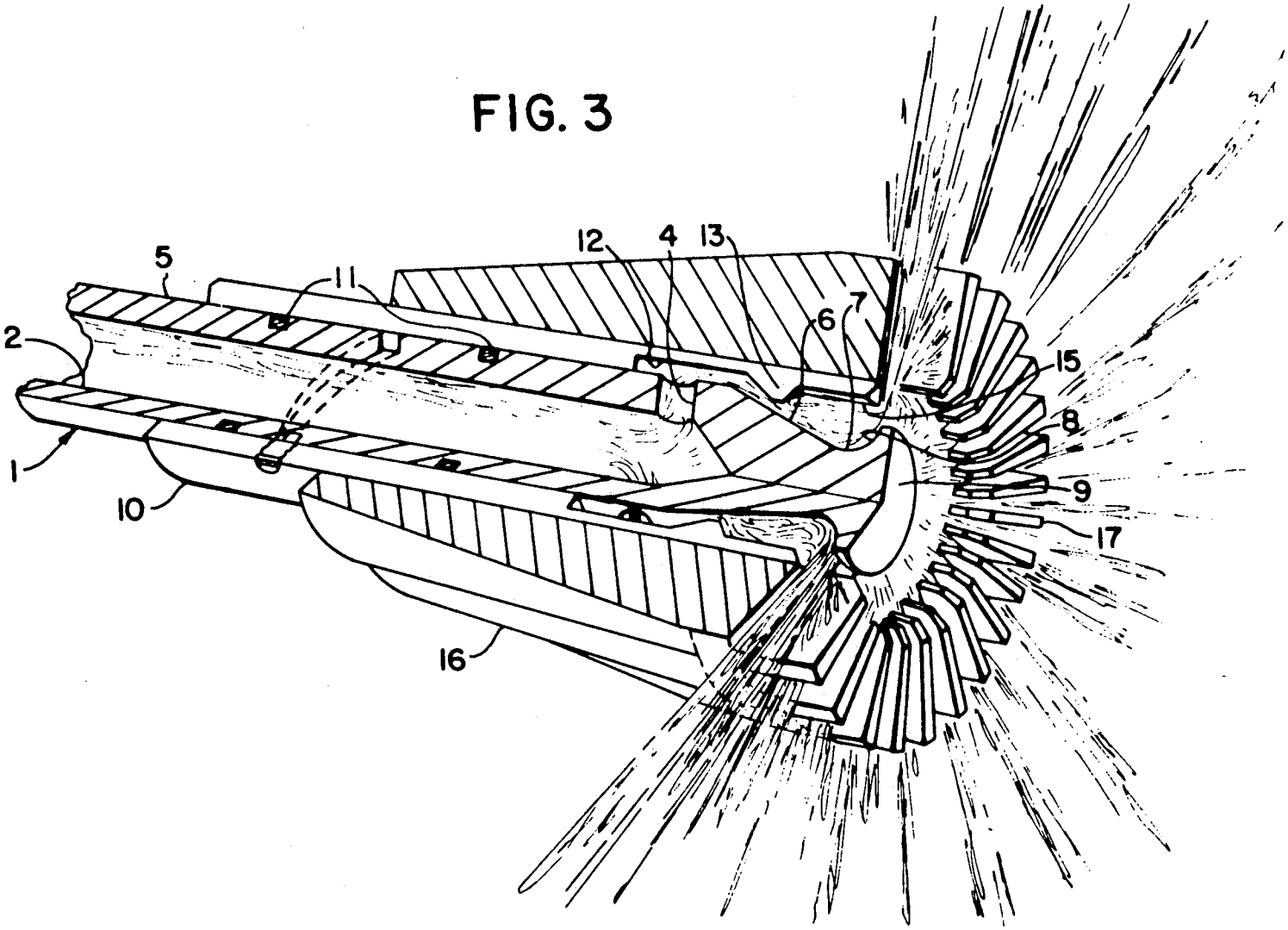

An embodiment of the invention will be described hereinbelow with reference to the accompanying drawings, in which:

FIG. 1 is a longitudinal section schematically showing a jet spray nozzle according to the invention in shut-off position, FIG. 2 is a similar longitudinal section of the same jet spray nozzle adjusted for producing a concentrated, forwardly directed jet, and FIG. 3 is a perspective view partly in longitudinal section of the same nozzle adjusted for producing a jet shield efficiently spread in the transverse direction of the nozzle.

The jet spray nozzle shown in the drawings consists of an inner control body 1 in the form of a sleeve which is closed at the mouth end of the nozzle and the inner cavity 2 of which, adjacent the closed sleeve end portion 3, communicates with the space surrounding the control body, through a number of bores 4 radially distributed along the circumference of the control body. After the bores 4, counting in the direction of flow, i.e. to the right in the drawings, the cylindrical portion 5 of the control body passes in a gently, preferably conically tapering portion 6 which, through a smoothly rounded portion 7, merges into the rear side 8 of a disc-shaped end portion 9 of the central control body 1. The control body is displaceably guided in an outer sleeve 10 which surrounds the control body and in relation to which the central control body is sealed by means of a number of 0-rings 11 mounted in grooves in the central control body. Outside the outlet openings of the radial bores 4, the outer sleeve has an internal recess 12 which, counting in the direction of flow, merges into a gently, preferably conically tapering portion 13 whose internal conical surface 14 passes, in the direction of flow, into a diameter which is slightly less than the maximum diameter of the concially tapering portion 6 of the central control body. Downstream of its portion 13, the outer sleeve passes into an internal cylindrical portion 15 which in the closing position shown in FIG. 1, where the conical portion 6 of the central control body engages the portion 13 of the outer sleeve, ends before the rear side 8 of the disc-shaped end portion 9 of the central control body. The outer sleeve is surrounded by a gripping sleeve 16 which preferably consists of soft material, such as rubber or plastics, and which suitably, but not necessarily, has radial wings 17 projecting in the direction of flow. When fluid pressure prevails in the interior of the central control body and, hence, also in the annular space 12 in the outer sleeve and the central control body 1 is moved to the left in the drawings, i.e. such that the conical surfaces 6 and 14 are moved slightly away from each other, the liquid flowing past the valve body thus formed will follow the preferably conical circumferential surface of the central body in a thin layer and at a high velocity. This thin layer of liquid, preferably water, will then be gently deflected against the rear side of the disc-shaped end portion 9 of the central control body into a radial direction, as appears from FIG. 3. This results in a liquid curtain spread in the transverse direction of the nozzle and efficiently deflected into a thin close shield the closeness of which increases by the scattering of the water droplets produced by the wings 17 of the gripping sleeve 16 projecting into the liquid shield.

When the inner control body 1 is moved further against the direction of flow into the position shown in FIG. 2, the disc-shaped end portion 9 will be retracted into the cylindrical end portion 15 of the outer sleeve and the conical surfaces 6 and 14 will be moved further away from each other so as to widen the passage therebetween. As a result, the liquid flow lamina producing effect of the conical surfaces ceases, and the liquid flow will be guided by the cylindrical end portion of the outer sleeve so as to form a well-centered jet.

In the illustrated embodiment, the conical surfaces seal directly against each other. This is appropriate when at least one of the parts consists of relatively soft material. If both parts consist of hard material, sealing can be effected by means of a supplementary sealing member provided in either one of the parts.

Since in connection with the displacement of the central control body in the opening direction in relation to the throttling portion of the outer sleeve, the disc-shaped end portion of the control body moves towards the free end of the outer sleeve, it is possible by a suitable axial location of these portions of the central control body and of the outer sleeve, to obtain a constant flow of liquid through the nozzle, substantially independently of the relative positions of displacement of the parts.

The invention is not restricted to the embodiment described above by way of example only and illustrated in the drawings, but may be varied as to its components within the scope of the accompanying claims without departing from the basic concept of the invention. Thus, for example, the design of the inner control sleeve may be varied, like the design of the outer sleeve. The inner sleeve need not necessarily be a homogeneous piece, as shown in the drawings, but may instead consist of a number of parts connected to each other, which may for instance be suitable when it is desirable, for reasons of manufacture or other reasons, to use different materials in the different parts of the sleeve. The annular recess 12 in the outer sleeve produces an excellent distributing effect on the water flowing through, but this distribution may of course be obtained otherwise, for instance by means of a suitable recess cut in the central control body. The smooth transition between the tapering portion of the central control body and the rear side of the disc-shaped end portion is not restricted only to the illustrated shape where the surfaces merge into each other along an arcuate line, but also implies transitions with small angular changes, although the true arc shape provides optimum effect.

I claim:

1. A jet spray nozzle which is adjustable between a position for producing a scattered flow an a position for producing a concentrated flow by axial displacement of a central control body (1) in relation to an outer sleeve (10) surrounding the central control body (1) characterized in that said central control body (1) has an inner open flow inlet end and a closed outer flow outlet end (3) formed as a valve head having:

a conical portion (6) gently tapering in the direction of flow and forming;

a narrow neck portion (7), and a disk-shaped end portion (9) having an inner face (8) wherein said narrow neck portion (7) smoothly merges with said inner face (8) to form a continuous surface;

said outer sleeve (10) has:

a gently tapering internal sleeve portion (13) complimentary to said conical portion (6) wherein said internal sleeve portion (13) has an inner diameter of up to an outer diameter of said control body (1) along said conical portion (6) whereby said internal sleeve portion (13) forms a seat upon engagement with said conical portion (6) when said outer sleeve (10) is moved against the direction of flow relative to said central control body (1) thereby closing said nozzle; and a cylindrical end portion (15) into which said disk-shaped end portion (9) is retracted when said outer sleeve (10) is moved in the direction of flow relative to said central control body (1) wherein said inner face (8) of said disk-shaped end portion (9) extends beyond said end portion (15) of said outer sleeve (10) when said nozzle is closed.

whereby axial displacement of said outer sleeve (10) in the direction of flow relative to said central body (1) opens said nozzle by forming an annular passage between said sleeve portion (13) and said conical portion (6) and the flow through the nozzle follows the gently tapering conical portion (6) of the central control body (1) and is deflected outwards in a radial direction by the inner face (8) of said disk-shaped end portion (9) so as to form a divergent curtain of flow in front of the nozzle without interference from the end portion (15) of the outer sleeve (10) and whereby further axial displacement of said outer sleeve (10) in the direction of flow relative to said central control body (1) retracts said disk-shaped end portion (9) into said cylindrical end portion (15) of said outer sleeve (10) thereby increasingly converging the flow in proportion to the displacement of the outer sleeve (10).

* * * * *